US007303401B2

(12) United States Patent
Schell et al.

(10) Patent No.: US 7,303,401 B2
(45) Date of Patent: Dec. 4, 2007

(54) ELECTRICAL CONNECTOR SYSTEM WITH HEADER CONNECTOR CAPABLE OF DIRECT AND INDIRECT MOUNTING

(75) Inventors: Mark S. Schell, Palatine, IL (US); Kevin N. Oursler, Portland, OR (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/439,746

(22) Filed: May 24, 2006

(65) Prior Publication Data

US 2006/0292934 A1 Dec. 28, 2006

Related U.S. Application Data

(60) Provisional application No. 60/693,135, filed on Jun. 23, 2005.

(51) Int. Cl.
*H01R 12/00* (2006.01)

(52) U.S. Cl. ..... 439/65; 439/79; 439/856

(58) Field of Classification Search ..... 439/65, 439/287, 660, 856, 857, 79, 947
See application file for complete search history.

(56) References Cited

U.S. PATENT DOCUMENTS 3,999,160 A * 12/1976 McDonnell ..... 362/227
4,632,475 A * 12/1986 Tomita ..... 439/1
4,790,763 A * 12/1988 Weber et al. ..... 439/65
4,818,237 A 4/1989 Weber ..... 439/693
4,881,905 A * 11/1989 Demler et al. ..... 439/79
4,975,062 A * 12/1990 Evans et al. ..... 439/13
5,173,063 A 12/1992 Barkus et al. ..... 439/681
5,551,883 A * 9/1996 Davis ..... 439/65
5,575,690 A 11/1996 Eaton ..... 439/717
5,582,519 A * 12/1996 Buchter ..... 439/101
5,727,961 A * 3/1998 Landis et al. ..... 439/287
6,089,925 A 7/2000 Maltais et al. ..... 439/701
6,299,492 B1 10/2001 Pierini et al. ..... 439/884
6,312,290 B1 11/2001 Belopolsky ..... 439/676
6,551,143 B2 * 4/2003 Tanaka et al. ..... 439/682
6,592,381 B2 7/2003 Cohen et al. ..... 439/80
6,644,980 B2 * 11/2003 Kameda ..... 439/65
6,835,103 B2 12/2004 Middlehurst et al. .... 439/699.1
2004/0235357 A1 11/2004 Allision et al. ..... 439/660

FOREIGN PATENT DOCUMENTS

WO WO 06/047071 A2 5/2006

* cited by examiner

*Primary Examiner*—Hien Vu
(74) *Attorney, Agent, or Firm*—Woodcock Washburn LLP

(57) ABSTRACT

A preferred embodiment of an electrical connector system for electrically connecting an electrical device and a substrate includes a header connector. The header connector has a contact. The contact includes a pin for engaging the electrical device; an intermediate portion electrically coupled to the pin for engaging a contact of a receptacle connector mounted on the substrate so that the header connector can be mounted on the substrate by way of the receptacle connector; and a tail electrically coupled to the intermediate portion for engaging the substrate so that the header connector can be mounted directly on the substrate.

15 Claims, 7 Drawing Sheets

ELECTRICAL CONNECTOR SYSTEM WITH HEADER CONNECTOR CAPABLE OF DIRECT AND INDIRECT MOUNTING

This application claims priority under 35 U.S.C. § 119(e) to U.S. provisional application No. 60/693,135, filed Jun. 23, 2005, the contents of which is incorporated by reference herein in its entirety.

BACKGROUND OF THE INVENTION

The present invention relates generally to electrical connectors, and more specifically to an electrical connector system having a header connector that can be mounted with or without the use of a receptacle connector.

Electronic devices are commonly connected to a substrate, such as a motherboard, using a connector system comprising a header connector and a receptacle connector configured to mate with the header connector.

Manufacturers of electronic devices generally attempt to package the components of the electronic device as densely as possible. The need for additional space to accommodate a receptacle connector therefore can be particularly disadvantageous.

SUMMARY OF THE INVENTION

The present invention is directed to a modular, orthogonal connector system that includes interlocking and interchangable housing/contact combinations. The present invention allows modular strips of header power and signal contacts to be cut to length and removably connected to a receptacle connector positioned on a substrate, such as a PCB. Because the header and receptacle overlap, space is saved. Moreover, the modularity and orthogonal mating provide greater flexibility.

The present invention certainly is not limited to a combination of a header and a receptacle. To address the ongoing need for an a connector system that can facilitate connection of a voltage regulation module (VRM) or other electronic device to a substrate by way of a header connector only, a preferred embodiment of an electrical connector system for electrically connecting an electrical device and a substrate comprises a header connector. The header connector comprises a contact. The contact comprises a pin for engaging the electrical device; an intermediate portion electrically coupled to the pin for engaging a contact of a receptacle connector mounted on the substrate so that the header connector can be mounted on the substrate by way of the receptacle connector; and a tail electrically coupled to the intermediate portion for engaging the substrate so that the header connector can be mounted directly on the substrate.

Another preferred embodiment of an electrical connector system comprises a header connector. The header connector comprises an insulator, and a contact mounted on the insulator for conducting electrical power. The contact comprises a pin for mating with an electrical device, and a body electrically connected to the pin and having an open-ended cavity defined therein.

Another preferred embodiment of an electrical connector system comprises a header connector comprising a contact, and an insulator attached to the contact. The insulator has at least one of a projection formed thereon and a slot formed therein.

The system also comprises a receptacle connector having a contact for engaging the contact of the header connector when the header connector and the receptacle connector are mated. The receptacle connector also includes a housing having the contact of the receptacle connector mounted thereon. The housing has at least one of a projection formed thereon and a slot formed therein.

The at least one of a projection and a slot of the receptacle connector engage the at least one of a projection and a slot of the header connector when the header connector and the receptacle connector are mated so that the header connector and the receptacle connector are maintained in a mated condition.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF PREFERRED EMBODIMENTS

Figure 1:
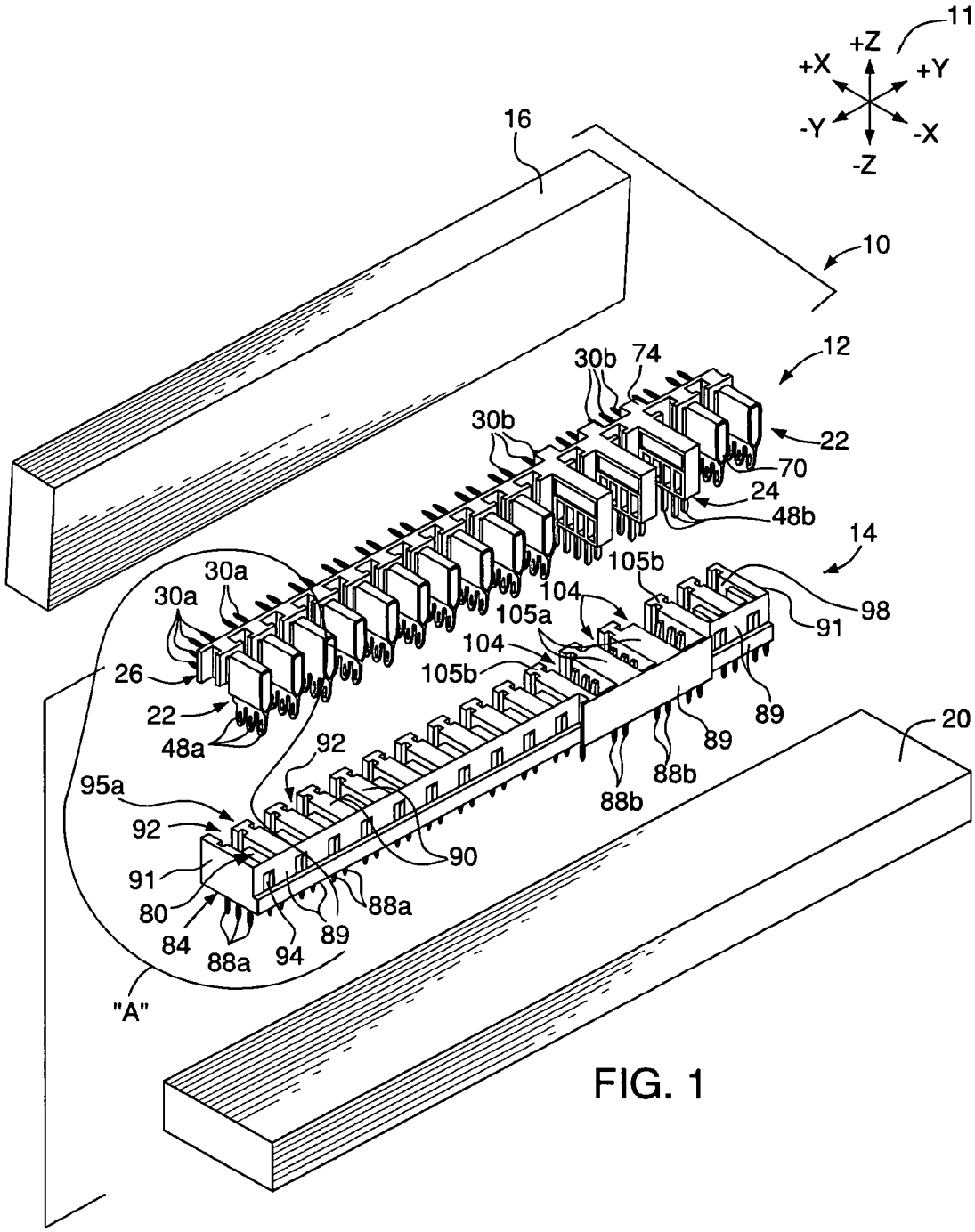
FIG. 1 is a rear perspective view of a preferred embodiment of an electrical connector system, showing a header connector and a receptacle connector of the system in an unmated condition.

FIGS. 1 to 7 depict a preferred embodiment of an electrical connector system 10. The figures are each referenced to a common coordinate system 11 depicted therein. The system 10 comprises a header connector 12, and a receptacle connector 14 that mates with the header connector 12. The header connector 12 can be mounted on a substrate 16 or on an electrical device such as a voltage regulator module (VRM). The receptacle connector 14 can be mounted on a substrate such as a PCB, daughtercard, or motherboard 20.

The header connector 12 can be mated with the receptacle connector 14 to electrically couple the substrate 16 and the motherboard 20. Alternatively, the header connector 12 can be mated directly with the motherboard 20, without the use of the receptacle connector 14. The following discussion, unless otherwise noted, pertains to an application in which the header connector 12 is used in conjunction with the receptacle connector 14.

The header connector 12 comprises twelve power contacts 22, and three signal-contact arrays 24. The header connector 12 further comprises an insulator 26 molded over portions of the power contacts 22 and the signal-contact arrays 24. It should be noted that the header connector 12 is depicted as including twelve of the power contacts 22 and three of the signal-contact arrays 24 for exemplary purposes only. Alternative embodiments can include more, or less than twelve power contacts 22 and three signal-contact arrays 24.

The centerline-to-centerline spacing between adjacent power contracts 22 is approximately 0.25 inch. It should be noted that the optimal value for the spacing is application-dependent, and can vary with factors such as the required throughput for each power contact 22, the desired spacing between the signal-contact arrays 24, the overall form factor of the header connector 12, etc. A particular value for the spacing is presented for exemplary purposes only.

Figure 2:
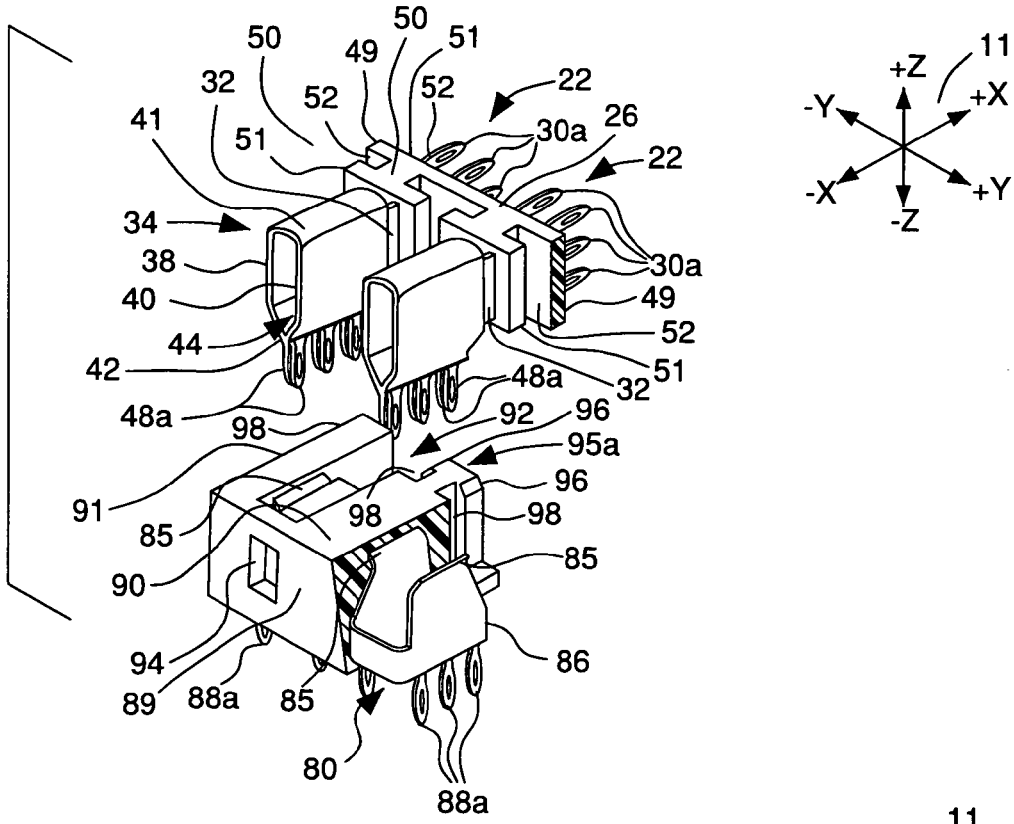
FIG. 2 is a magnified view of the area designated "A" in FIG. 1, showing the header connector and the receptacle connector in the unmated condition.
Figure 3:
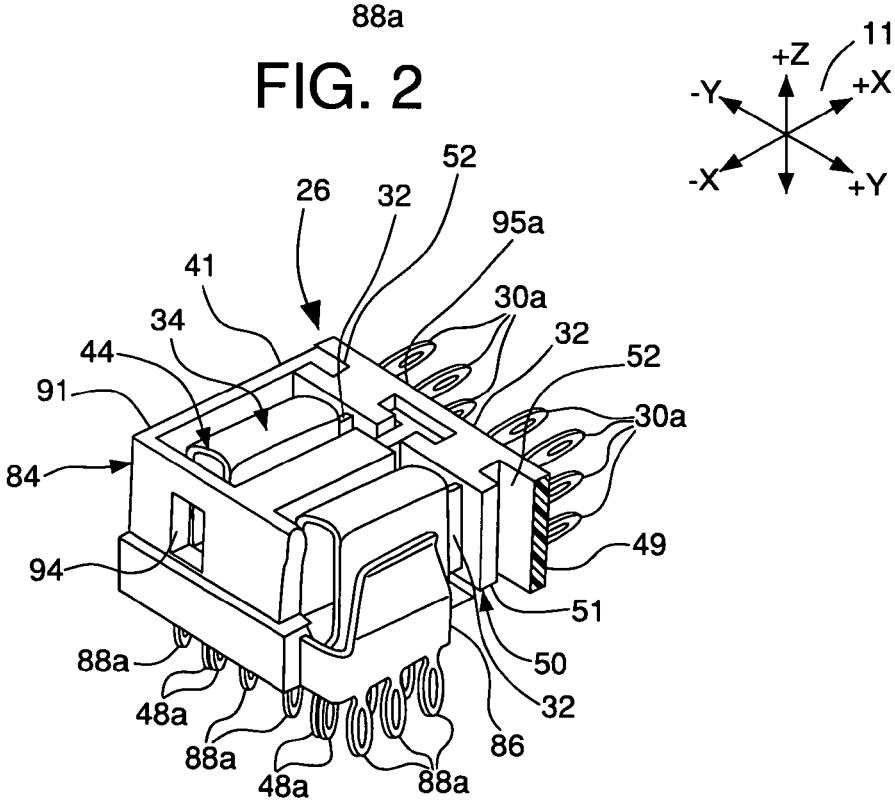
FIG. 3 is a magnified view of the area depicted in FIG. 2, showing the header connector and the receptacle connector in a mated condition.

The power contacts 22 each comprise eight pins 30*a*. The pins 30*a* can be arranged in two spaced-apart, vertical columns, as depicted in FIGS. 1-3. Preferably, the pins 30*a* are eye-of-the-needle type contacts. The pins 30*a* can be press fit into plated through holes or vias formed in the substrate 16, to form paths for conducting electrical power between the header connector 12 and the substrate 16. The through holes or vias in the substrate 16 are not depicted in the figures, for clarity. The power contacts 22 are depicted as including eight of the pins 30*a* for exemplary purposes only. Alternative embodiments of the power contacts 22 can include more, or less than eight pins 30*a*. Surface mount technology, i.e., solder balls, can also be used in place of the pins in any of the disclosed embodiments.

Each power contact 22 further comprises two vertically-oriented blades 32, as depicted in FIGS. 2 and 3. Three of the pins 30*a* adjoin a first of the blades 32, and the other three pins 30*a* adjoin the second blade 32.

Each power contact 22 also comprises a body 34. The body 34 includes a front portion (not shown) that adjoins the blades 32. The body 34 also includes a first and a second side portion 38, 40 that adjoin the front portion. The body 34 further includes a top portion 41, and a bottom portion 42 that each adjoin the first and second side portions 38, 40. The first and second side portions 38, 40 are spaced apart, so that the body 34 defines an internal cavity 44. A rearward end of the cavity 44 is open, as shown in FIGS. 1-3.

The first and second side portions 38, 40, and the two blades 32 can increase the current-carrying capacity of the power contact 22, in comparison to a power contact that uses a single blade in lieu of these components. Moreover, the open end of the cavity 44 permits air to circulate into and out of the cavity 44.

Each power contact 22 also includes six tails 48*a* that adjoin the bottom portion 42 of the body 34, as shown in FIGS. 1 and 3. Preferably, the tails 48*a* are eye-of-the-needle type contacts. The tails 48*a* preferably have a tin-lead coating applied thereto. Each tail 48*a* can be press fit into a non-plated through hole formed in the motherboard 20 when the header connector 12 is mated with the receptacle connector 14. The through holes in the motherboard 20 are not shown in the figures, for clarity. The tails 48*a* are not normally used to transmit power when the header connector 12 is used in conjunction with the receptacle connector 14. As discussed below, the tails 48*a* are used to transmit power in applications where the header connector 12 is mounted directly on the motherboard 20.

The power contacts 22 are depicted as including six of the tails 48*a* for exemplary purposes only. Alternative embodiments of the power contacts 22 can include more, or less than six tails 48*a*.

Each tail 48*a* is preferably located proximate another of the tails 48*a*, to form a closely-spaced, or abutting, pair of the tails 48*a*. Each pair of tails 48*a* can be received in a single, appropriately-sized through hole in the motherboard 20.

The insulator 26 is molded over a portion of each blade 32 so that the pins 30*a* extend from a forward face of the insulator 26, as shown in FIGS. 1-3. The insulator 26 has a forward portion 49, and an adjoining mating portion 50. The projections 51, and the adjacent forward portion 49, define slots 52. As discussed below, the projections 51 and the slots 52, along with complementary features on the receptacle connector 14, help to retain the header connector 12 and the receptacle connector 14 in a mated condition.

Figure 5:
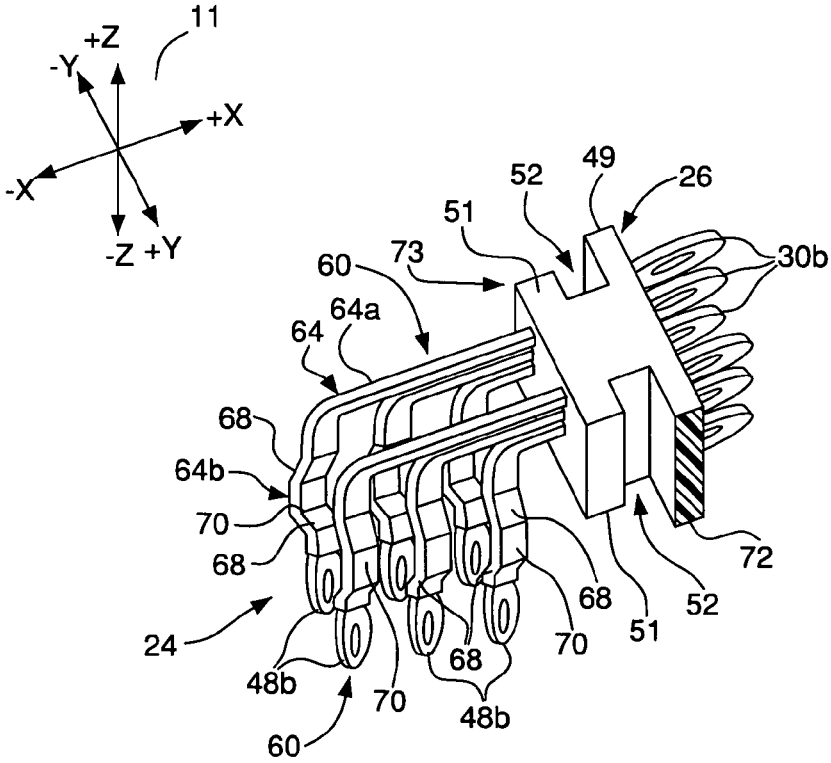
FIG. 5 is perspective view of a signal-contact array and an insulator of the header connector of the system shown in FIGS. 1-4, with a portion of the insulator removed to show underlying leads of the signal contact array.

Each signal-contact array 24 of the header connector 12 comprises eight electrical conductors 60. The conductors 60 are arranged in two nested groups, as shown in FIG. 5. For clarity, one conductor 60 of each group is not shown in FIG. 5. The signal-contact arrays 24 are described as including eight of the conductors 60 for exemplary purposes only. Alternative embodiments of the signal-contact arrays 24 can include more, or less than eight conductors 60.

The centerline-to-centerline spacing between adjacent signal-contact arrays 24 is approximately 0.30 inch. It should be noted that the optimal value for the spacing is application-dependent, and can vary with factors such as the noise requirements imposed on the signal-contact arrays 24, the desired spacing between the power contacts 22, the overall form factor of the header connector 12, etc. A particular value for the spacing is presented for exemplary purposes only.

Each conductor 60 comprises a pin 30*b*, and a lead 64 that adjoins the pin 30*b*. Preferably, the pins 30*b* are eye-of-the-needle type contacts that are substantially identical to the pins 30*a* of the power contacts 22. The pins 30*b* can be press fit into plated through holes or vias formed in the substrate 16, to form signal and ground paths between the header connector 12 and the substrate 16.

The lead 64 has a bend of approximately ninety degrees formed therein, as shown in FIG. 5. The bend separates the lead 64 into a first portion 64*a* oriented substantially in the horizontal direction, and a second portion 64*b* oriented substantially in the vertical direction.

Each conductor 60 also includes a tail 48*b* that adjoins the second portion 64*b* of the lead 64. Preferably, the tails 48*b* are eye-of-the-needle type contacts that are substantially identical to the tails 48*a* of the power contacts 22. Each tail 48*b* can be press fit into a non-plated through hole formed in the motherboard 20 when the header connector 12 is mated with the receptacle connector 14. The tails 48*b* are not normally used to form signal and ground paths between the header connector 12 and the motherboard 20, when the header connector 12 is used in conjunction with the receptacle connector 14. As discussed below, the tails 48*b* are used to form signal and ground paths between the header connector 12 and the motherboard 20 in applications where the header connector 12 is mounted directly on the motherboard 20.

Figure 6:
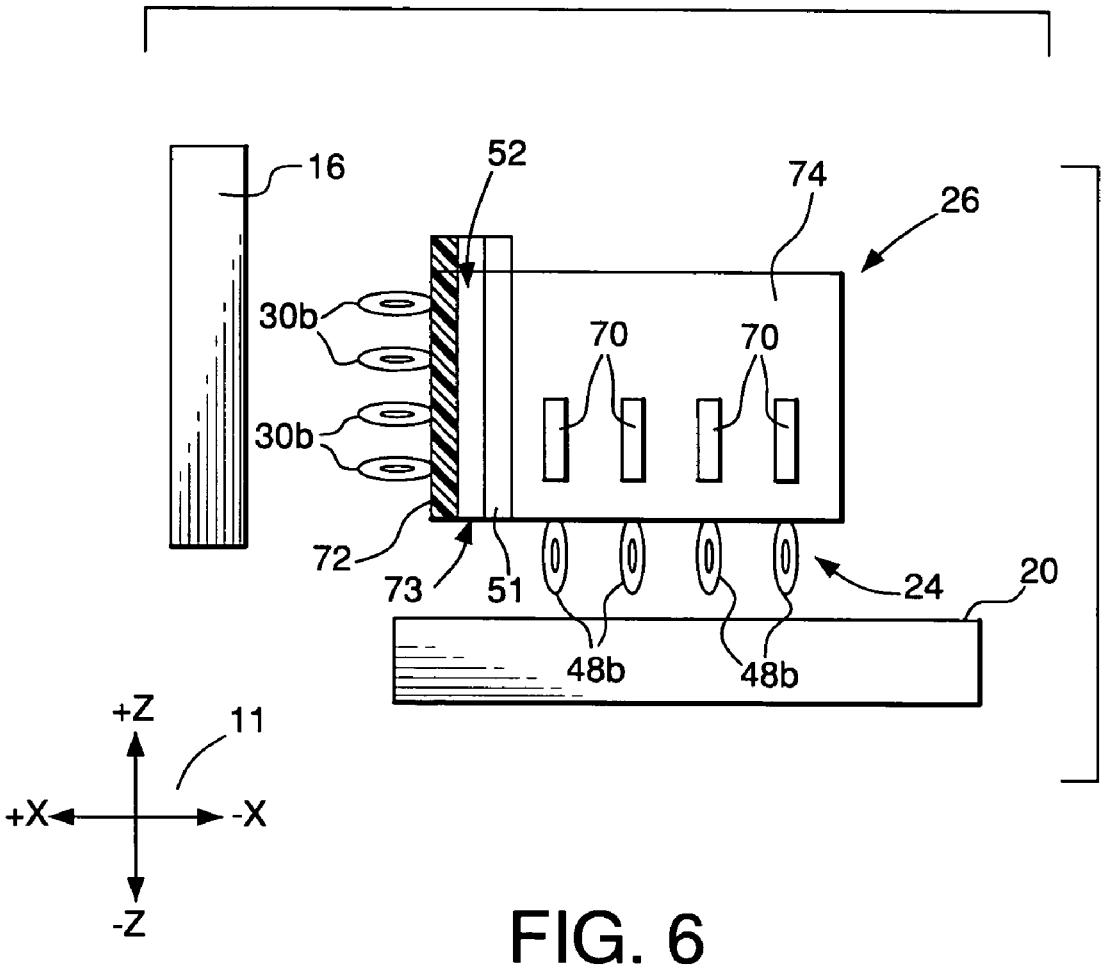
FIG. 6 is side view of the signal-contact array and the insulator of the header connector of the system shown in FIGS. 1-5.

The second portion 64*b* of each conductor 64 has two jogs 68 formed therein. The jogs 68 form an outwardly-projecting offset 70 in the second portion 64*b*, as shown in FIGS. 5 and 6. The offsets 70, as discussed below, facilitate electrical contact between the signal-contact array 24 and associated conductors in the receptacle 14, while helping to minimize the overall footprint of the tails 48*b* on the motherboard 20.

The insulator 26 is molded over the signal-contact arrays 24 as shown in FIG. 6. The portion of the insulator 26 associated with each signal-contact array 24 includes a forward portion 72, a mating portion 73, and a housing portion 74, as shown in FIGS. 1, 5, and 6. The housing portion 74 is not depicted in FIG. 5, in order to show the underlying leads 64.

The pins 30*b* extend from a forward face of the forward portion 72, as shown in FIG. 6. The mating portion 73 includes two of the projections 51 described above in relation to the mating portion 50. The projections 51, and the adjacent forward portion 72, define two of the slots 52. The projections 51 and the slots 52, along with complementary features on the receptacle connector 14, help to retain the header connector 12 and the receptacle connector 14 in a mated condition.

The housing portion 74 is molded over the leads 64 so that the offset 70 of each lead 64 is exposed, and projects slightly from the surrounding surface of the housing portion 26 as shown in FIG. 6. This feature, as discussed below, facilitates contact between the conductors 64 and complementary electrically-conductive features on the receptacle connector 14. The tails 48*b* extend downward from the housing portion 26*b*, as shown in FIG. 6.

The receptacle connector 14 comprises twelve power contacts 80, and six signal-contact arrays 82. The receptacle connector 14 also comprises a molded, electrically-insulative housing 84. It should be noted that the receptacle connector 14 is depicted as including twelve of the power contacts 80 and six of the signal-contact arrays 82, to match the configuration of the power contacts 22 and signal-contact arrays 24 of the receptacle contacts 12. Alternative embodiments can include more, or less than eight of the power contacts 80 and six of the signal-contact arrays 82, as required to match the configuration of power contacts 22 and signal-contact arrays 24 of the receptacle connector 12 in a particular application.

Figure 4:
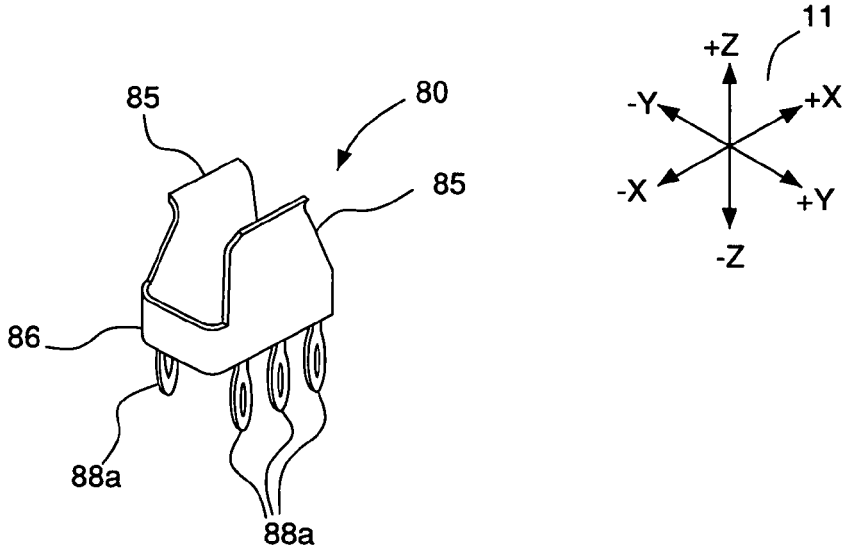
FIG. 4 is perspective view of a power contact of the receptacle connector of the system shown in FIGS. 1-3.

The power contacts 80 each comprise a first and a second arm 85, and a base 86 that adjoins the first and second arms 85, as shown in FIG. 4. Each power contact 80 also includes six tails 88*a* that adjoin, and extend downward from the base 86. The tails 88*a* are preferably eye-of-the-needle type contacts. The tails 88*a* preferably have a gold coating applied thereto. The tails 88*a* can be press fit into plated through holes or vias formed in the motherboard 20, to form signal and ground paths between the receptacle connector 14 and the motherboard 20.

The first and second arms 85 extend upward, from opposing sides of the base 86. The first and second arms 85 are angled inward, i.e., toward each other, as they extend upward. The first and second arms 85 act as spring contacts. In particular, the first and second arms 85 contact the respective first and second side portions 38, 40 of the body 34 of an associated one of the power contact 22, when the plug connector 12 is mated with the receptacle connector 14. The upper ends of the first and second arms 85 are spaced so that the body 34 urges the first and second arms 85 apart as the body 34 is inserted therebetween. The resilience of the first and second arms 85 gives rise to a contact force between the first and second arms 85 and the body 34, and provides wiping action as the power contacts 22, 80 are mated. The upper ends of the first and second arms 85 are preferably flared outward, to help guide the body 34 between the first and second arms 85.

The relatively compact configuration of the first and second arms 85, it is believed, helps to minimize overall height of the receptacle connector 14. The configuration of the first and second arms 85 is also believed to help to minimize the length of the electrical path between the body 34 and the tails 88*a* when the header and receptacle connectors 12, 14 are mated. Reducing the length of the electrical path can increase the current throughput of the power contact 80, and can provide more favorable inductance characteristics.

The housing 84 is molded around the base 86 of each power contact 80. The housing 84 has a rear wall 89, a plurality of partitions 90 that each adjoin the rear wall 89, and two end walls 91, as shown in FIG. 1. The rear wall 89, the partitions 90, and the end walls 91 define cavities 92, as best shown in FIG. 2. The first and second arms 85 of each power contact 80 are located within an associated cavity 92, proximate opposing sides of the cavity 92.

The first and second arms 85 of each power contact 80 receive the body 34 of a corresponding power contact 22 when the receptacle connector 14 and the header connector 12 are mated, as discussed above. Each cavity 92 therefore accommodates the first and second arms 85 of an associated power contact 80, as well as the body 34 of an associated power contact 22.

The portion of the rear wall 89 associated with each cavity 92 has a window 94 formed therein, as shown in FIG. 1-3. The window 94 places the associated cavity 92 in fluid communication with the ambient environment around the receptacle connector 14. Each window 94 substantially aligns with the cavity 44 of an associated power contact 22 when the header connector 12 and the receptacle connector 14 are mated. The window 94 thus permits heated air to exit the cavity 44 during operation of the connector system 10, while permitting relatively cool ambient air to enter the cavity 44. The window 94 thereby facilitates convective cooling of the associated power contact 22 and power contact 80.

The width ("y" dimension) of each cavity 92 is approximately equal to the width of the base 86 of the power contacts 80. This feature can help to ensure that the first and second side portions 38, 40 of the power contact 22 are substantially aligned with the respective first and second arms 85 of the power contact 80 as the header connector 12 and the receptacle connector 14 are mated. Aligning the first and second arms 85 and the first and second side portions 38, 40 in this manner can help to minimize the potential for the first and second arms 85 to be damaged during the mating process.

Each partition 90 has a substantially T-shaped mating portion 95*a*, as shown in FIGS. 1-3. The mating portions 95*a* each include two projections 96. Each projection 96 helps to define a slot 98. Each end wall 91 also includes one projection 96 that helps to define a slot 98.

The slots 98 each receive an associated projection 51 of the header connector 12, when the header connector 12 and the receptacle connector 14 are mated, as shown in FIG. 3. Moreover, the projections 96 each become disposed within an associated slot 52 of the header connector 12 when the header connector 12 and the receptacle connector 14 are mated.

Preferably, the slots 98 and the projections 51 are sized so that the projections 51 are restrained from upward movement within the associated slots 98 by friction. The slots 52 and the projections 96 likewise are sized so that the projections 96 are restrained from upward movement within the associated slots 52 by friction. Alternative embodiments of the header connector 12 and the receptacle connector 14 can utilize latches or other means in lieu of, or in addition to a friction fit to secure the header connector 12 to the receptacle connector 14 in the vertical direction.

The projections 51, 96 acts as keys that, along with the slots 52, 98, form an interlock that restrains the header connector 12 and the receptacle connector 14 from relative movement in the lateral ("y") and axial ("x") directions. Moreover, the interlock provided by the projections 51, 96 and the slots 52, 98 allows the insulator 26 and the housing 84 to react forces and moments due to, for example, the weight of the substrate 16, external forces applied to the substrate 16 or the motherboard 20, differential thermal expansion of the substrate 16 and the motherboard 20, etc. In other words, the slots 52, 98 and the projections 51, 96 allow forces to the transmitted between the header connector 12 and the receptacle connector 14 by way of the insulator 26 and the housing 84, rather than through the power contacts 22 and the associated power contacts 80. The interlocking members can also be sized and shaped to allow keying of a power contact housing and a signal contact housing.

Figure 7:
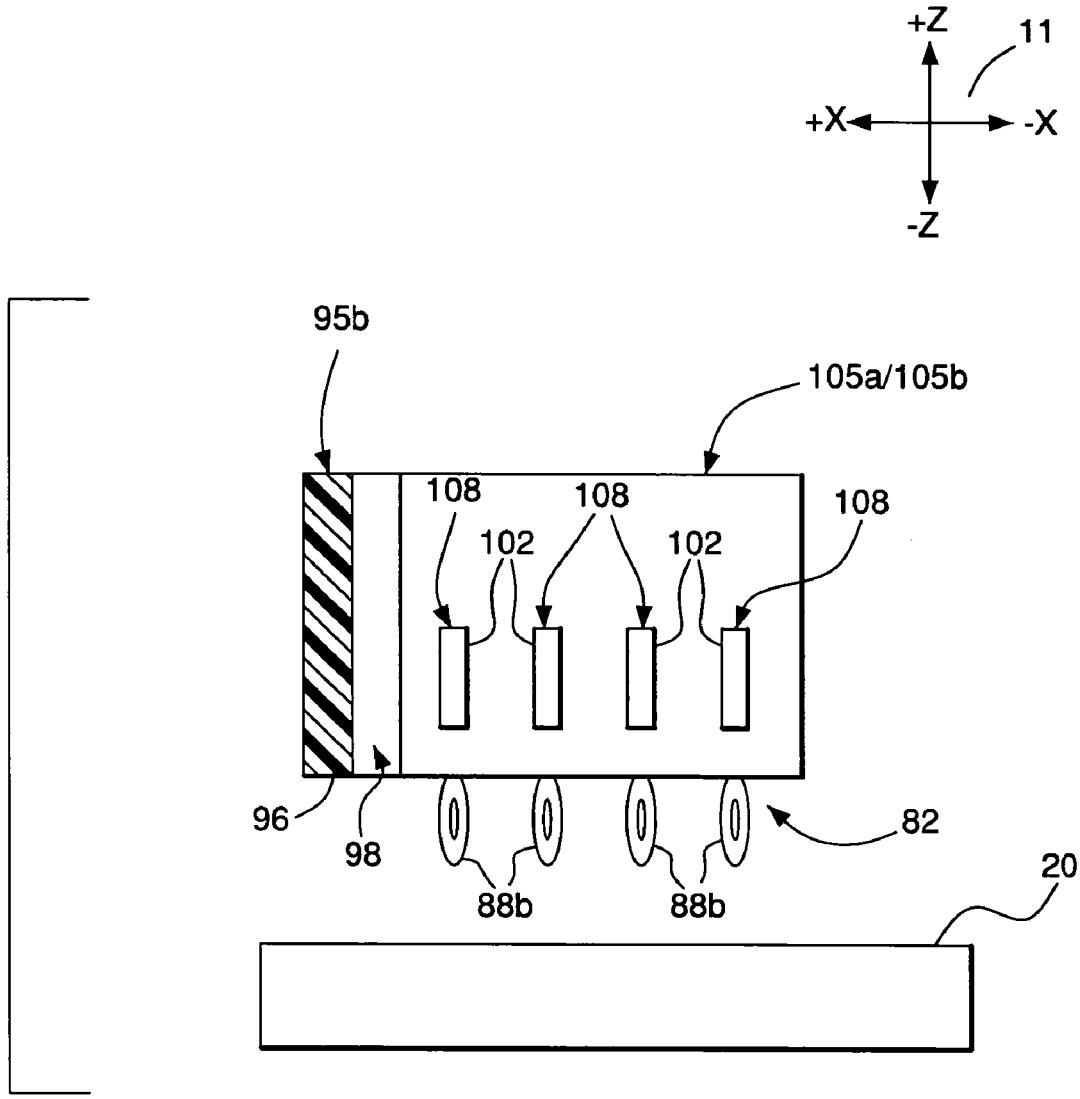
FIG. 7 is side view of a signal-contact array and a housing of the receptacle connector of the system shown in FIGS. 1-6.

Each signal-contact array 82 comprises four electrically-conductive leads 102, and a plurality of tails 88*b* that each adjoin a respective one of the leads 102, as shown in FIG. 7. Preferably, the tails 88*b* are eye-of-the-needle type contacts that are substantially identical to the tails 88*a*. The tails 88*b* can be press fit into plated through holes or vias formed in the motherboard 20 when the header connector 12 is mated with the receptacle connector 14, to form signal and ground paths between the header connector 12 and the motherboard 20.

The housing 84 further includes partitions 105*a*, 105*b*, as shown in FIGS. 1 and 7. The partitions 105*b* are associated with the end most signal-contact arrays 82. Each partition 105*b* is molded over the leads 102 associated with one signal-contact array 82, i.e., each partition 105*b* is molded over four of the leads 102. Each partition 105*a* is molded over the leads 102 associated with two signal-contact arrays 82, i.e., each partition 105*b* is molded over eight of the leads 102.

The partitions 105*a*, 105*b* have slots 108 formed therein for providing access to each lead 102, as shown in FIG. 7. The partitions 105*a*, 105*b*, and the portion of the rear wall 80 associated with the partitions 105*a*, 105*b* define cavities 104, as shown in FIG. 1. Each cavity 104 receives an associated housing portion 74 of the insulator 26 when the header connector 12 and the receptacle connector 14 are mated.

The leads 102 are positioned within the partitions 105*a*, 105*b* so that each lead 102 contacts and wipes an associated offset 70 of the header connector 12, when the header connector 12 and the receptacle connector 14 are mated. This contact establishes electrical contact between the signal-contact arrays 24, 82.

Each partition 105*a*, 105*b* has a mating portion 95*b*, as shown in FIG. 7. The mating portion 95*b* is substantially identical to the mating portion 95*a* of the partitions 90. The mating portions 94*b* each include two of the projections 96. Each projection 96 helps to define one of the slots 98.

The slots 98 of the mating portions 95*b* each receive an associated projection 51 of the insulator 26 of the header connector 12, when the header connector 12 and the receptacle connector 14 are mated. Moreover, the projections 96 each become disposed within an associated slot 52 of the header connector 12, when the header connector 12 and the receptacle connector 14 are mated.

The slots 98 and the projections 96 associated with the mating portions 95*b* act as retaining and interlocking features, in a manner substantially identical to the slots 98 and the projections 96 associated with the mating portions 95*a*.

The connector system 10 optionally can include a cover (not shown) for covering the power contacts and the housing portions when the header connector 12 and the receptacle connector 14 are mated.

The head connector 12 can be mounted directly on the motherboard 20, without the use of the receptacle 14, as noted above. In this type of application, all of the power transmitted through the header connector passes through the tails 48*a* of the power contacts 22 and the associated plated through holes or vias. Signal and ground paths between the header connector 12 and the motherboard 20 are formed by the tails 48*b* and the associated plated through holes or vias in this type of application.

The header connector 12 can be used with or without the receptacle connector 14 at the discretion of the user. The receptacle connector 12 can be used by itself, for example, when the vertical ("z" axis) space available for the substrate 16 is relatively limited. For example, the vertical distance between the mounting surface of the motherboard 20 and the top of the substrate 16 can be approximately 1.10 inches when the header connector 12 is used exclusively to electrically connect the motherboard 20 and the substrate 16, i.e., when the header connector is mounted directly on the motherboard 20. It should be noted that this particular dimension is presented for exemplary purposes only, and can vary in applications where alternative embodiments of the header connector 12 are used.

Each tail 48*a* of the power contacts 22 is preferably located proximate another of the tails 48*a*, to form a closely-spaced, or abutting, pair of tails 48*a*, as discussed above. Each pair of tails 48*a* is received in a plated through hole or via in the motherboard 20, when the header connector 12 is mounted directly on the motherboard 20. Power therefore is transmitted between the header connector 10 and the motherboard 20 by way of the tails 48*a*.

The above-noted pairing arrangement for the tails 48*a* can allow the number of tails 48*a* associated with each power contact 22 to be doubled, without substantially increasing the area on the motherboard 20 needed to accommodate the tails 48*a*. Increasing the number of tails 48*a* on each power contact 22 can increase the current-carrying capacity of the power contact 22. Hence, pairing the tails 48*a* in the above-noted manner can increase the throughput of the power contact 22, without substantially increasing the footprint of the power contact 22 on the motherboard 20. Pairing the tails 48*a* also helps to provide separation between the tails 48*a* and the tails 88*a* of the power contacts 80, when the header connector 12 is used in conjunction with the receptacle connector 14.

Each tail 48*b* of the signal contact arrays 24 can be press fit into a plated through hole or via formed in the motherboard 20 when the header connector 12 is mounted directly on the motherboard 20, to form a signal or a ground path between the header connector 12 and the motherboard 20. The signal and ground paths between the header connector 12 and the motherboard 20 are formed exclusively by the tails 48*b* of the header connector 12, in this embodiment.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

Figure 8:
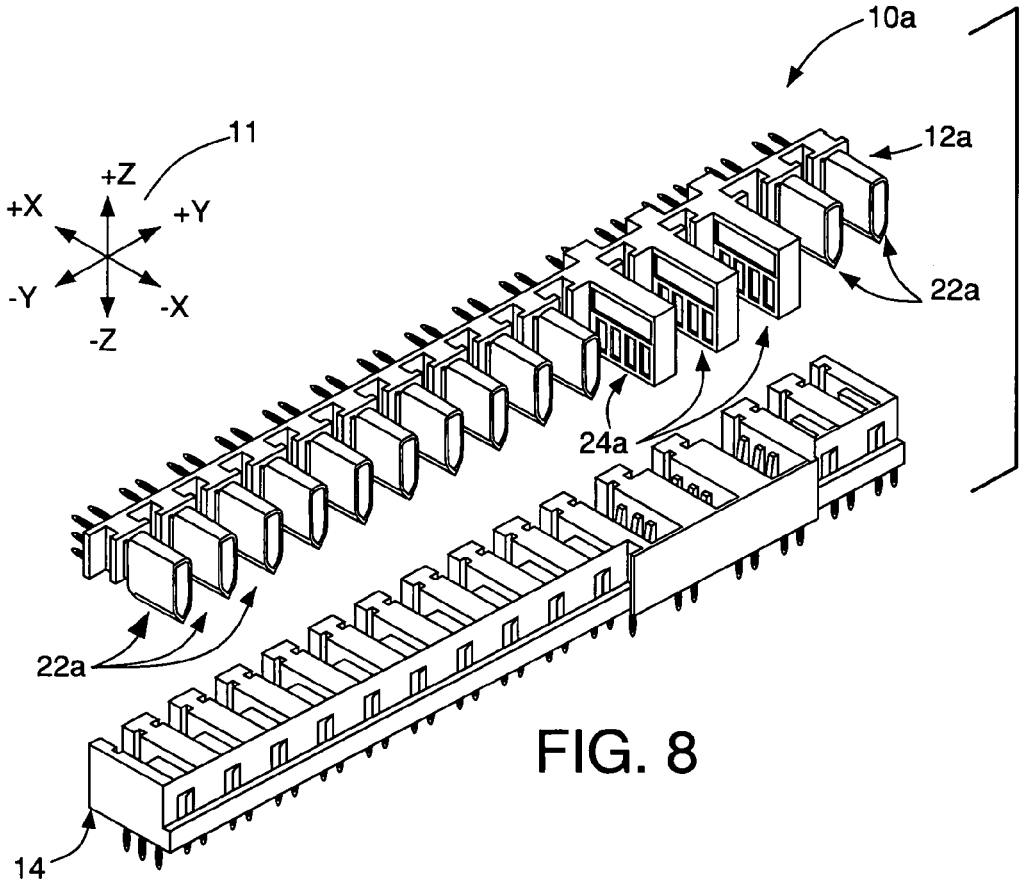
FIG. 8 is a top view of an alternative embodiment of the connector system shown in FIGS. 1-7.

For example, FIG. 8 depicts an alternative embodiment of the connector system 10 in the form of a connector system 10*a*. The system 10*a* comprises a header connector 12*a*, and the receptacle connector 14. The header connector 10*a* comprises power contacts 22*a*. The power contacts 22*a* do not includes tails, such as the tails 48*a* of the power contacts 22. In this embodiment, power is transmitted between the header connector 10*a* and the motherboard 20 exclusively by way of the power contacts 80 of the receptacle connector 14.

The header connector 10*a* also comprises signal-contact arrays 24*a* that do not include tails such as the tails 48*b* of the signal-contact arrays 24. The signal and ground paths between the header connector 10*a* and the motherboard 20 are formed exclusively by the signal-contact arrays 82 of the receptacle connector 14, in this embodiment.

The configuration of the system 10*a* preserves the modularity of the header connector 12*a* after the header connector 12*a* and the receptacle connector 14 are mated. In particular, the header connector 12*a* does not mate directly with the motherboard 20. Hence, the header connector 12*a* can be de-mated from the receptacle connector 14 with relative ease. This feature can facilitate replacement of the header connector 12*a* without a need to rework or replace the receptacle connector 14 or the motherboard 20. The interlocking housings and the optional cover keep the housings releasably locked together.

Other variations in the connector system 10 are also possible. For example, the power contacts 80 and the signal-contact arrays 82 of the receptacle connector 14 can be formed without the respective tails 88*a*, 88*b*. In this embodiment, electrical contact with the motherboard 20 can be established exclusively by the tails 48*a*, 48*b* of the respective power contacts 22 and signal-contact arrays 24 of the header connector 12. This particular configuration can be used where modularity of the header connector 12 after mating with the receptacle connector 14 is not required.

Figure 9:
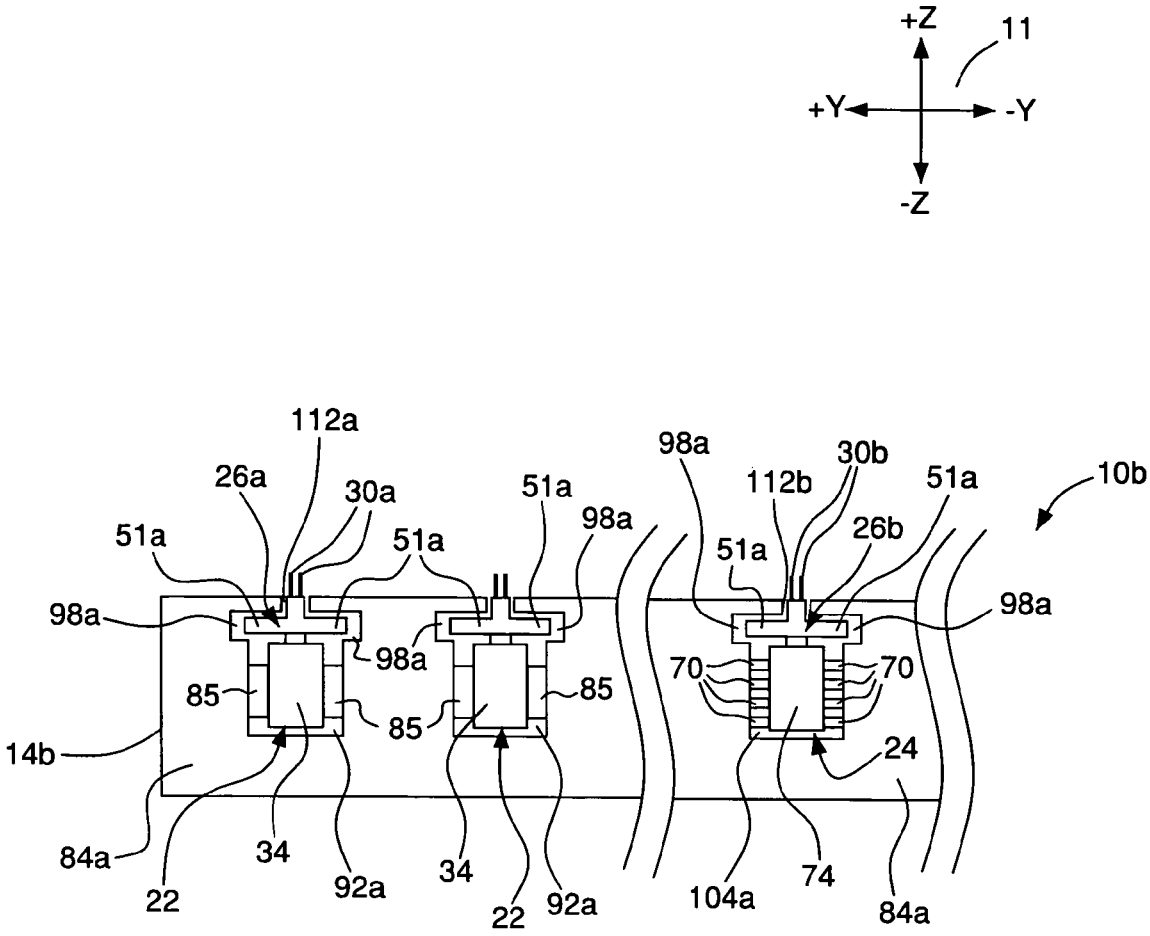
FIG. 9 is a top view of another alternative embodiment of the connector system shown in FIGS. 1-7.

FIG. 9 depicts another alternative embodiment of the connector system 10 in the form of a connector system 10*b* comprising header connectors 12*b* and a receptacle connector 14*b*. Each header connector has a power contact 22 molded to a separate insulator 26*a* associated only with that particular power contact 22. The insulator 26*a* includes two projections 51*a*.

The receptacle connector 14*b* includes a housing 84*a*. The housing 84*a* has cavities 92*a* defined therein for receiving an associated insulator 26*a* and power contact 22 of the header connector 12*a*. Each cavity 92*a* adjoins a slot 112*a* that extends inward from a forward face of the housing 84*b*. The slot 112*a* accommodates a portion of the insulator 26*a* of the power contact 22, so that the power contact 22 can be fully inserted into the cavity 92*a*.

The projections 51*a* become disposed in slots 98*a* formed in the housing 84*a*, when the header connector 12*b* is mated with the receptacle connector 14*b*. The projections 51*a* and the slots 98*a* act as interlocking features, in the manner discussed above in relation to the projections 51 and the slots 98 of the header connector 12 and the receptacle connector 14.

Each signal contact array 24 of the header connector 12*b* likewise is molded to a separate insulator 26*b* associated only with that particular signal-contact array 24. The housing 14*b* includes cavities 104*a* for receiving an associated insulator 26*b* and signal-contact array 24.

Each cavity 104*a* adjoins a slot 112*b* that extends inward from the forward face of the housing 84*b*. The slot 112*b* accommodates a portion of the insulator 26*b*, so that the signal-contact array 24 can be fully inserted into the cavity 104*a*.

The insulator 26*b* has two of the projections 51*a* formed therein. The projections 51*a* become disposed in associated slots 98*a* formed in the housing 84*a*, when the header connector 12*b* is mated with the receptacle connector 14*b*.

The insulator 26 of the header connector 12 is unitarily formed. Alternatively, the insulator 26 can be formed in multiple pieces. For example, the portions of the insulator 26 associated with the power contacts 22 and the signal-contact arrays 24 can be formed separately. In one possible production method, a large number of power contacts 22, i.e., more power contacts than needed for a particular header connector 12, can be mounted on a relatively long strip of insulator 26. The insulator 26 can be cut at an appropriate location thereon to form a smaller strip, sized for the header connector 10. A strip of insulator 26 having signal-contact arrays 24 mounted thereon can be formed and cut to size in a similar manner. If desired, the resulting strips can be joined by a suitable method, such as adhesive bonding, to form the header connector 10. The housing 84 of the receptacle connector 14 can be formed in separate pieces, in a similar manner.

What is claimed is:

1. An electrical connector system for electrically connecting an electrical device and a substrate, the system comprising a receptacle connector comprising an insulative housing and a receptacle contact having a tail that engages the substrate when the receptacle connector is mounted on the substrate; and a header connector that mates with the receptacle contact, the header connector comprising a contact, the contact of the header connector comprising: a pin that engages the electrical device when the header connector is mounted on the electrical device; an intermediate body portion electrically coupled to the pin that engages the receptacle contact so that the header connector can be mounted on the substrate by way of the receptacle connector; and a tail electrically coupled to the intermediate body portion and extending though the receptacle contact so that the tail engages the substrate when the receptacle and header connectors are mated and the receptacle connector is mounted on the substrate and so that the header connector can be mounted directly on the substrate, the header connector further comprising an insulator attached to the pin of the contact of the header connector, the insulator having mating features configured to engage complementary mating features on the housing of the receptacle connector when the header connector and the receptacle connector are mated.

2. The system of claim 1, wherein the header connector further comprises a contact array comprising a plurality of electrical conductors each comprising a pin for engaging the electrical device, a lead electrically coupled to the pin for engaging a lead of the receptacle connector so that the header connector can be mounted on the substrate by way of the receptacle connector, and a tail electrically coupled to the lead for engaging the substrate so that the header connector can be mounted directly on the substrate.

3. The system of claim 2, wherein the insulator is molded over the contact array and the lead of the header connector has an offset formed therein so that the lead of the receptacle connector can contact the lead of the header connector by way of the offset.

4. The system of claim 1, further comprising a second header connector comprising a contact array comprising a plurality of electrical conductors each comprising a pin for engaging the electrical device, a lead electrically coupled to the pin for engaging a lead of the receptacle connector so that the second header connector can be mounted on the substrate by way of the receptacle connector, and a tail electrically coupled to the lead for engaging the substrate so that the second header connector can be mounted directly on the substrate.

5. The system of claim 1, further comprising a second tail electrically coupled to the intermediate body portion, the tails being positioned so that the tails can be received in a single through hole formed in the substrate.

6. The system of claim 1, wherein the intermediate body portion adjoins the tail and defines an open-ended cavity that facilitates circulation of air into and out of the body.

7. An electrical connector system comprising: a header connector, the header connector comprising an insulator and a contact, the contact comprising: a contact pin mounted on the insulator for conducting electrical power and for mating with an electrical device, an intermediate body portion electrically connected to the pin and having an open-ended cavity defined therein, a first tail adjoining the body, and a second tail adjoining the body and being located proximate the first tail so that the first and second tails can be received in a single through hole formed in a substrate; and a receptacle connector for mating with the header connector, the receptacle connector comprising an insulative housing having a through hole formed therein, the through hole substantially aligning with the cavity defined in the body when the header connector and the receptacle connector are mated, the receptacle connector further comprising a contact mounted in the housing, the contact of the receptacle connector comprising: a base; a first and a second arm adjoining the base for engaging the contact of the header connector; and a tail adjoining the base for engaging a substrate.

8. The system of claim 7, wherein the intermediate body portion includes a first and a second side portion, and a top portion and a bottom portion each adjoining the first and second side portions so that the first and second side portions are spaced apart.

9. The system of claim 8, wherein the contact of the header connector further comprises a first and a second blade adjoining the intermediate body portion, and a first and a second pin adjoining the respective first and second blades for engaging the electrical device.

10. The system of claim 7, wherein the first and second arms engage the intermediate body portion of the contact of the header connector when the header connector and the receptacle connector are mated, and the first and second arms resiliently deflect in response to engagement of the intermediate body portion so that a contact force is generated between the intermediate body portion and the first and second arms.

11. The system of claim 7, wherein the header connector further comprises a contact array comprising a plurality of electrical conductors each comprising a pin for engaging the electrical device, a lead electrically coupled to the pin for engaging a lead of the receptacle connector, and a tail electrically coupled to the lead for engaging the substrate.

12. The system of claim 7, wherein the contact of the header connector further comprises a tail adjoining the intermediate body portion for engaging the substrate, the tail of the contact of the header connector being offset from the tail of the contact of the receptacle connector when the header connector and the receptacle connector are mated.

13. An electrical connector system, comprising:

a header connector comprising a contact including a pin that extends in a first direction and is configured to mate with an electrical device, an intermediate body portion, and a tail coupled to the intermediate body portion, the header connector further comprising an elongated insulator attached to the contact by the pin, the insulator having at least one of a projection formed thereon and a slot formed therein; and a receptacle connector having a receptacle contact for engaging the contact of the header connector when the header connector and the receptacle connector are mated, the contact of the receptacle connector including a tail that extends in a second direction substantially perpendicular to the first direction and is configured to mate with a substrate, and an insulative housing having the contact of the receptacle connector mounted thereon, the housing having at least one of a projection formed thereon and a slot formed therein, the at least one of a projection and a slot of the receptacle connector engaging the at least one of a projection and a slot of the header connector when the header connector and the receptacle connector are mated in the second direction so that the header connector and the receptacle connector are maintained in a mated condition, wherein the tail of the contact of the header connector extends through the receptacle contact so that the header connector can be mated directly to the substrate.

14. The system of claim 13, wherein:

the header connector further comprises a contact array comprising a plurality of electrical conductors each comprising a pin for engaging the electrical device, and a lead electrically coupled to the pin and having an offset formed therein;

the contact of the receptacle connector comprises base, and a first and a second arm electrically coupled to the base for engaging the contact of the header connector; and the receptacle connector further comprises a plurality of electrical conductors each comprising a lead for engaging a respective one of the offsets of the header connector, and a tail electrically coupled to the lead for engaging the substrate.

15. The system of claim 14, wherein the contact of the header connector further comprises a tail electrically coupled to the body for engaging the substrate; and the fourth electrical conductors of the header connector each further comprise a tail electrically coupled to a respective one of the leads of the fourth electrical conductors of the header connector for engaging the substrate.

* * * * *